United States Patent [19]

Dudrey et al.

[11] 4,406,651

[45] Sep. 27, 1983

[54] MULTI-PHASE SELF PURGING CENTRIFUGE

[75] Inventors: Denis J. Dudrey, Bloomington; John T. Herman, Mahtomedi; Bernard A. Matthys, Apple Valley, all of Minn.

[73] Assignee: Donaldson Company, Inc., Minneapolis, Minn.

[21] Appl. No.: 368,651

[22] Filed: Apr. 15, 1982

[51] Int. Cl.[3] ..... B04B 1/10; B04B 11/00

[52] U.S. Cl. ..... 494/29; 494/56; 494/62; 494/63; 494/65; 494/74; 494/79; 494/83; 210/377

[58] Field of Search ..... 494/27, 29, 56, 62, 494/63, 65, 74, 79, 83; 210/377, 379

[56] References Cited

U.S. PATENT DOCUMENTS

| | | | |
|---|---|---|---|
| Re. 26,986 | 11/1970 | Keith . | |
| 347,702 | 8/1886 | Evans | 494/79 |
| 500,787 | 7/1893 | Williams . | |
| 555,893 | 3/1896 | Anderson . | |
| 1,232,104 | 7/1917 | Sharples . | |
| 1,492,699 | 5/1924 | Rasch . | |
| 1,533,313 | 4/1925 | Forsberg . | |
| 2,003,621 | 6/1935 | Andersson . | |
| 2,084,487 | 6/1937 | Haraldson . | |
| 2,089,122 | 8/1937 | Jones . | |
| 2,395,286 | 2/1946 | Merle . | |
| 2,587,206 | 2/1952 | Pattinson . | |
| 2,710,718 | 6/1955 | Denman . | |
| 2,921,969 | 1/1960 | Loy . | |
| 2,928,592 | 3/1960 | Johnson . | |
| 3,145,174 | 8/1964 | Ambler . | |
| 3,490,947 | 1/1970 | Grieselhuber . | |
| 3,623,657 | 11/1971 | Trump . | |
| 3,687,360 | 8/1972 | Prew . | |
| 3,718,278 | 2/1973 | Conklin . | |
| 3,784,092 | 1/1974 | Gibson . | |
| 3,861,584 | 1/1975 | Dudrey | 494/56 |
| 3,888,410 | 6/1975 | McKee . | |
| 3,904,109 | 9/1975 | Underwood . | |
| 4,007,871 | 2/1977 | Jones . | |

*Primary Examiner*—Robert W. Jenkins

*Attorney, Agent, or Firm*—Merchant, Gould, Smith, Edell, Welter & Schmidt

[57] ABSTRACT

A centrifuge apparatus (10) for separating multi-phase fluid is disclosed. The centrifuge apparatus (10) includes a bowl-like structure (12) rotatably mounted in a housing (14) for rotation about a vertical axis. The centrifuge apparatus (10) further includes means for introducing multi-phase fluid into the bowl (12) and means for driving the bowl (12) at a predetermined rotation speed. A rotor assembly is coaxially mounted in the bowl (12) for rotation therewith to accelerate or impel the multi-phase fluid such that the fluid is separated into heavier phase fluid and lighter phase fluid with solid particles being collected on the inner surface of a bowl side wall portion (16).

A top wall member (18) of the bowl (12) defines axially directed openings (50) therein for discharging the heavier phase fluid. Discharge means positioned in the cylindrical side wall portion (16) extend radially into the interior of the bowl (12) for discharging the lighter phase fluid. The centrifuge apparatus (10) further includes purge means for dislodging solid particles accumulated on the cylindrical side wall portion (16). Drain means provided in the bowl (12), drains the fluid with resuspended particles from the bowl during the purge cycle.

9 Claims, 4 Drawing Figures

MULTI-PHASE SELF PURGING CENTRIFUGE

TECHNICAL FIELD OF THE INVENTION

The present invention relates to centrifuge apparatus. In particular, the present invention relates to a multi-phase fluid centrifuge which is self-cleaning.

BACKGROUND OF THE INVENTION

Centrifuge apparatus for separating multi-phase or multi-density fluids are known in the art. Such centrifuge apparatus are particularly useful in industry wherein coolants are circulated through the various working parts of machines in an effort to prevent overheating. However, after a period of use the coolants frequently become contaminated with various fluids such as tramp oils, both free and emulsified, due to leaks in the equipment, etc. In addition, the working parts are subject to wear and solid particles which break off therefrom may become trapped in the coolant. Consequently, it is necessary to separate the heavier phase fluid or coolant from the lighter phase fluid, such as tramp oils, and the solid particulate suspended therein, on a periodic or continuous basis.

Much effort has gone into developing multi-phase centrifuges. Typically, however, expensive special purpose apparatus have been developed. While these units may be effective, they are often too expensive and not suited for varying applications. In addition, many of these units are not self-cleaning, thereby necessitating that they be shut down and manually cleaned. Many of the units are rather intricate, having a large number of working parts, thereby necessitating substantial maintenance throughout the lifetime thereof. Furthermore, many of these units do not provide for a continuous discharge of cleaned fluid or coolant.

The present invention solves the above mentioned problems and many other problems associated with the prior art.

SUMMARY OF THE PRESENT INVENTION

The present invention relates to a centrifuge apparatus for separating multi-phase fluid. In addition, the present invention will also function to remove solid particulate suspended in the fluid. The present invention includes a housing having a vertical axis. A bowl having a cylindrical side wall portion and a bottom wall portion, is mounted in the housing for rotation about the vertical axis. In addition, the bowl is enclosed by a top wall member. The centrifuge apparatus further includes means for introducing multi-phase fluid into the bowl proximate the bottom portion thereof and means for driving the bowl at a predetermined rotational speed. A rotor assembly is coaxially mounted in the bowl proximate the bottom portion for rotation therewith. The rotor assembly rotates with the bowl to accelerate or impel the multi-phase fluid and any solid particles suspended therein outwardly toward the cylindrical side wall portion, whereby the fluid is separated into heavier phase fluid and lighter phase fluid while the solid particles are collected on the inner surface of the cylindrical side wall portion.

The top wall member defines axially directed openings therein for discharging the heavier phase fluid. Baffle means extend transversely of the bowl proximate the top wall member so as to prevent the lighter phase fluid from discharging through the openings in the top wall member. Discharge means positioned in the cylindrical side wall portion and extending radially into the interior of the bowl discharge the lighter phase fluid from the bowl interior. The centrifuge apparatus further includes purge means for abruptly stopping the rotation of the bowl to initiate a purge cycle by disrupting the rotation of the fluid, whereby solid particles or material accumulated on the inner surface of the cylindrical side wall portion are dislodged therefrom and resuspended in the fluid. Drain means provided in the bowl, drain the fluid with resuspended particles from the bowl during the purge cycle.

In one embodiment of the present invention, a plurality of purge rods are vertically mounted in the centrifuge bowl near the periphery thereof to provide increased purging efficiency by further disrupting the rotating fluid when the bowl is abruptly stopped.

In yet another embodiment of the present invention, there is a drain baffle apparatus near the bottom portion of the centrifuge bowl for reducing the rate at which fluid drains from the centrifuge bowl during the purge cycle.

The present invention because of its few working parts and simplified design can be readily and inexpensively constructed. In addition, the present invention has a reduced maintenance schedule and an extended period of usefulness. Furthermore, the present invention is capable of self-purging and provides a continuous discharge of heavier phase fluid, e.g. coolant, when in operation. The present invention, additionally, is suited for a wide variety of applications.

These and various other advantages and features of novelty which characterize the invention are pointed out with particularlity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views.

DETAILED DESCRIPTION OF THE INVENTION

Figure 1:
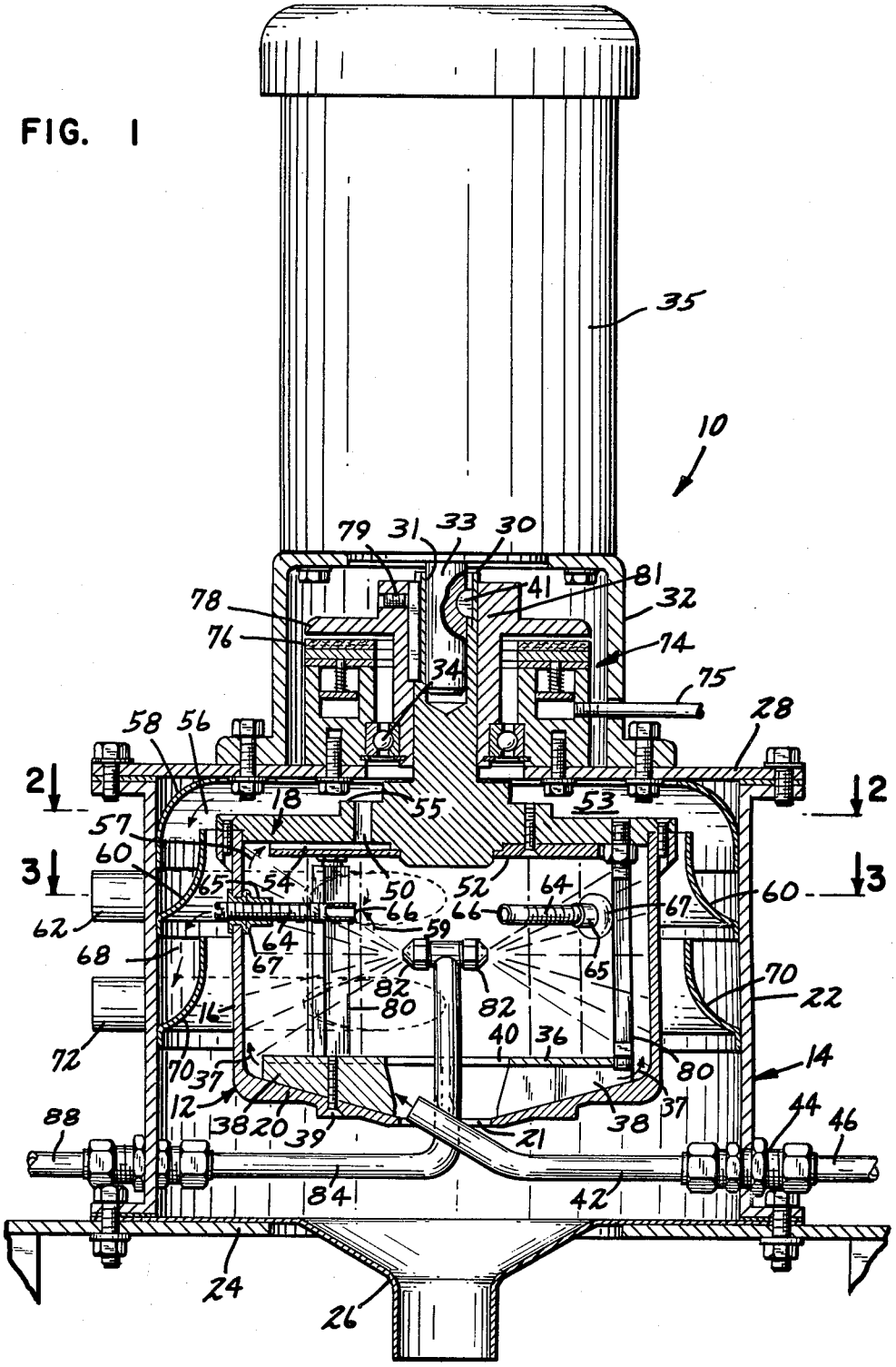
FIG. 1 is an elevational view in cross-section of the present invention.

Referring now to FIG. 1, there is shown an embodiment of a centrifuge apparatus, generally designated by the reference numeral 10, embodying the principles of the invention. The centrifuge 10 includes a drum or bowl-like structure 12 concentrically and rotatably mounted within a housing 14 for rotation about a vertical axis. The centrifuge bowl 12 includes a cylindrical side wall portion 16, a top bowl cover member 18 suitably attached thereto, and a cone shaped bottom portion 20 defining an aperture 21 therein. Housing 14 includes a cylindrical side wall portion 22 which is suitably attached to a platform or table top member 24, which in turn, has suitably attached thereto a frusto conical member 26 projecting vertically downward therefrom. Suitably attached to the side wall portion 22 is a top cover member 28.

The top cover member 18 of the centrifuge 10 includes a shaft or axial extension 30, integral with the cover member 18, which extends vertically through an aperture in the housing cover 28 into a housing 32. The shaft 30 is operatively connected to a drive shaft 33 of a drive mechanism or motor 35 which imparts rotational motion to the shaft 30 and correspondingly to the centrifuge bowl 12. The shaft 30 rotates on bearings 34 suitably mounted on the housing cover 28 within the housing 32. In the embodiment shown in FIG. 1, the shaft 30 defines a bore 31 extending a predetermined axial distance from the top end thereof. The bore is adapted for receiving the motor drive shaft 33 which is secured therein by a woodruff key apparatus 41 or the like. The present invention might also be belt driven as opposed to direct drive.

Conentrically mounted in the centrifuge bowl 12 is an impeller or accelerator section which includes an annular plate 36 extending transversely of the centrifuge bowl and fixedly attached thereto by vertically and radially extending, spaced standoffs or fins 38 to the bottom portion 20. In the embodiment shown, there are four such fins 38 symmetrically arranged about and outwardly from the vertical axis of the centrifuge (See FIG. 3). The fins 38 have a somewhat elongated diamond shape so as to provide an enlarged cross-section near the center thereof for reception of a screw 39 or the like which attaches the fins to the bottom portion 20.

It will be understood that the fins 38 may be made integral with the bowl and/or plate or fastened through other methods whereby the enlarged cross-section would not be necessary. Indeed, in an alternate embodiment the standoffs might be integrally formed as a single piece with the centrifuge bowl 12 with a separate annular plate riveted or suitably attached thereto.

The standoffs are spaced so as to define radially directed fluid flow paths between adjacent standoffs and the annular plate 36. Fins 38 have an outside diameter less than the inside diameter of the centrifuge bowl structure 12 so as to define a fluid flow path between the outer periphery of the impeller section and the cylindrical side wall 16 as generally indicated by arrows 37 in FIG. 1. As the centrifuge bowl 22 rotates, the impeller section rotations therewith, thereby causing a rotation of the fluids and solids within the bowl. The impeller section will accelerate very quickly and impart angular momentum to fluid entering the bottom portion of the centrifuge bowl in a manner creating minimal turbulence of the fluid already contained within the bowl.

Figure 3:
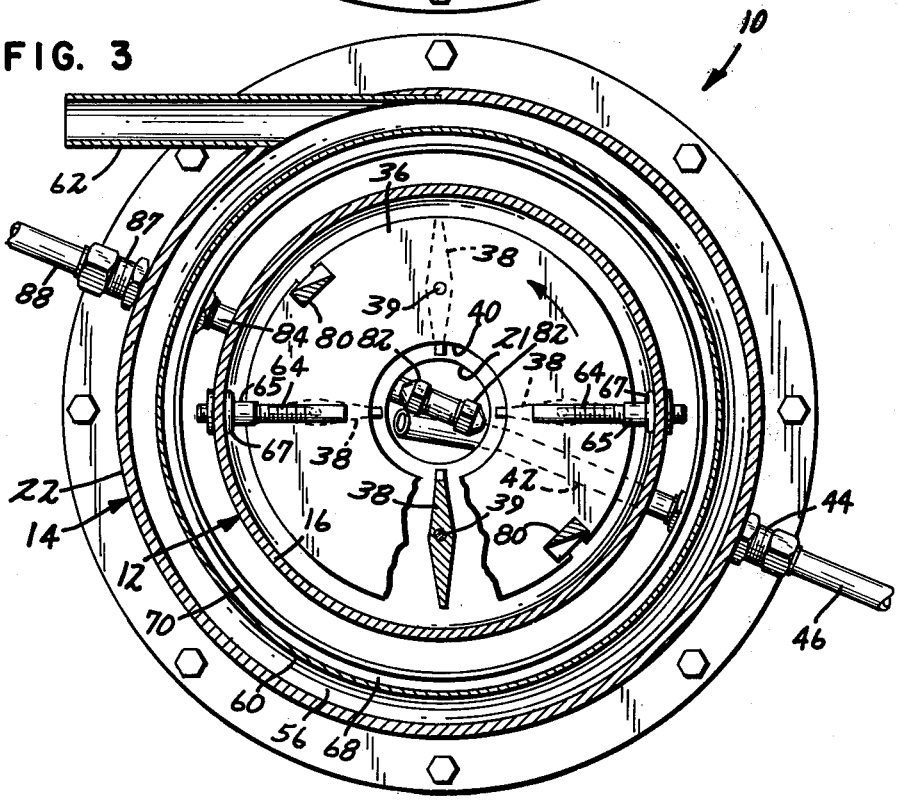
FIG. 3 is a view along line 3—3 in FIG. 1.

Annular plate 36 further defines an aperture 40 in the center thereof (See FIG. 3). In the embodiment shown, the inner edges of the standoffs are angled such that the top portions thereof terminate at the periphery of the aperature in the annular plate and the bottom portions of the inner edges terminate a predetermined distance radially inward of the top portions. (See FIG. 1)

Contaminated fluid, that is fluid containing various pollutants such as tramp oils, etc., enters the rotating centrifuge bowl 12 through a feed pipe 42 which extends through the aperture in the cone shaped bottom 20 of the bowl and upward into the hollow cylindrical space defined by the inner edges of the standoffs 38. Feed pipe 42 has a generally horizontal section which is suitably attached to the housing side wall 22 via connection 44. Feed pipe 42 is connected to a line 46 which contains a contaminated fluid being pumped by a suitable pumping source. At a predetermined distance inward of housing wall 22, feed pipe 42 is bent such that the end of the feed pipe projects upward and through aperture 21 at an incline generally in a direction toward the bowl side wall 16. In a preferred embodiment feed pipe 42 might be a one-half inch outside diameter copper tube. It will be understood, however, that the size of the feed pipe is a factor of the volume of fluid flow rates through the centrifuge bowl.

As the contaminated fluid is introduced into the rotating centrifuge bowl 12, the impeller section imparts a rotating motion to the fluid, thereby directing or throwing the fluid and solid particles therein outwardly toward the cylindrical side wall 16 of the rotating bowl. The contaminated fluid exits the impeller section through the flow paths defined by the fins 38 and enters that portion of the centrifuge bowl 12 above the impeller section whereby separation of the various phases or densities of fluid occurs.

As the fluids are separated, solids suspended in the fluids, if any, accumulate on the inner surface of the rotating bowl cylindrical wall 16 due to the centrifugal force. The heavier phase fluid, which is largely contaminant free, gathers as a cylindrical ring, radially inwardly of the solids, between the annular plate 36 at the bottom of the bowl and the cover of the bowl. Droplets of lighter phase fluid migrate toward the top of the bowl 12 and radially inwardly of the heavier phase fluid where they accumulate as a cylindrical ring of lighter phase fluid. Typically there will be an area at the center of the bowl which, because of the rapid rate at which the bowl rotates, will have no fluid and this forms an air space or cavity within the rotating bowl.

Figure 2:
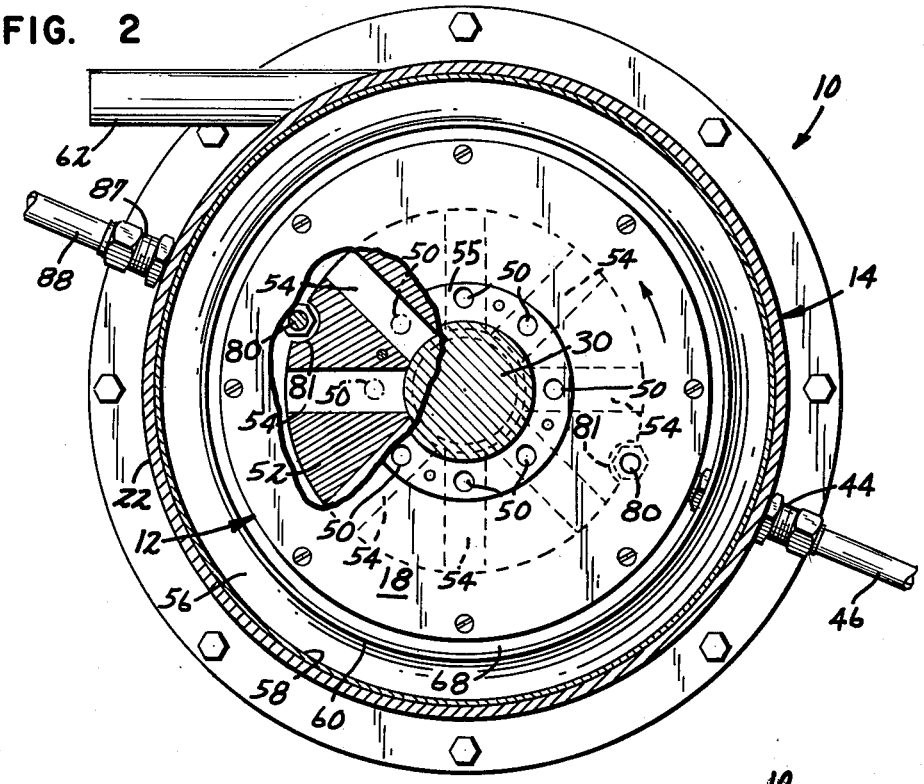
FIG. 2 is a view along line 2—2 in FIG. 1.

As the fluid builds up, heavier phase fluid is discharged, as generally indicated by arrows 57, through a plurality of annular exit ports 50 in the centrifuge bowl cover 18. Axially directed ports 50 in a preferred embodiment, as illustrated in FIG. 2, are positioned symmetrically about the vertical axis of the centrifuge a predetermined radial distance therefrom and are eight in number. It will be appreciated, that the size of the exit ports and number thereof may vary depending on the flow rates required in the particular application of the invention.

The periphery of aperture 40 in annular plate 36 is farther radially removed from the bowl side wall 16 than the exit ports 50 such that as the cylindrical ring or wall of heavy phase fluid concentrically builds up proximate the bowl side wall 16, the fluid inner surface will encounter the exit ports 50 prior to reaching the periphery of aperture 40 in th bottom of the bowl. Consequently, the heavier phase fluid will be forced out the exit ports 50 in the cover 18 rather than the opening 40.

The exit ports 50 are each protected by an annular shield plate 52 concentrically and fixedly mounted to the bottom surface of the centrifuge bowl cover 18. The shield plte 52 defines radially extending passages 54 which connect exit ports 50 with the interior of the centrifuge bowl 12. The radially extending passages 54 are open at the ends farthest radially removed from the centrifuge bowl center so as to define fluid flow paths extending from proximate the periphery of the centrifuge bowl 12 to the exit ports 50. In a preferred embodiment, the eight evenly spaced exit ports 50 are each protected by and in communication with a separate radially extending passage 54 defined in the shield plate 52.

The shield plate 52 thus allows fluid from the outer portion of the centrifuge bowl 12, the heavier phase fluid or coolants, to exit the bowl through the exit ports 50, with the lighter phase fluid, such as oil, being prevented from escaping through the exit ports 50.

Additionally, the angular momentum of the fluid moving radially inward is transferred to the rotating bowl, thereby reducing the torque and thus the power required to drive the centrifuge bowl. Without the radially extending barriers of the passageways 54 in the shield plate 52, the tangential velocity of the fluid moving radially inward would increase according to the law of conservation of momentum given by the following equation:

$$V_t R = K$$

where:

$V_t$ = tangential velocity

R = radius

K = a constant

As the fluid moves radially inwardly towards the vertical axis, the radius (R) value is decreasing, therefore in order to maintain a constant (K) value, the tangential velocity ($V_t$) value must increase. As the tangential velocity of the fluid starts to increase, the fluid forces against the radially extending barriers of the passageways 54 thereby imparting increased rotational motion to the centrifuge bowl 12. Furthermore, the fluid is prevented from obtaining an increased velocity. Thus, the present invention is energy efficient as the energy associated with increased fluid velocity is not wasted.

Additionally, if the fluid is allowed to increase its velocity, a backpressure will be exerted into the centrifuge bowl. The back pressure will affect or vary the location of the fluid layers, thereby having an adverse effect on the operation of lighter phase fluid discharge tubes 64 suitably attached to side wall 16.

In the preferred embodiment illustrated, there is a flange or lip portion 55 coaxially positioned on the top surface of the top cover 18 and integral therewith. The exit ports 50 extend axially through the flange portion 55 such that the upper ends of the exit ports 50 are elevated above the top surface of the bowl cover 18. Thus, as the fluid exits from the exit ports 50 it is flowing above the top surface of the bowl cover 18 such that energy from the rotating bowl is not transferred to the fluid. This provides for further conservation of energy and assures the fluid does not obtain too much velocity prior to reaching the periphery of the centrifuge bowl.

The exit ports 50 are interconnected to a radially extending annular cavity 53 positioned between the centrifuge housing top cover member 28 and the bowl cover member 18 so as to provide an unobstructed discharge space facing radially outwardly toward a coolant passage 56 defined by curved baffles or splash cone members 58 and 60 respectively which are suitably attached to housing 14.

Splash cone members 58 and 60 direct the heavier phase fluid into the coolant passageway 56 which extends circumferentially about centrifuge bowl 12 within housing 14. As illustrated in FIGS. 2 and 3, interconnected tangentially to coolant passageway 56 is a coolant recovery outlet 62 which carries off the substantially clean coolant or heavier phase fluid.

As illustrated in FIG. 1, the centrifuge bowl has two of the hollow discharge tubes 64 symmetrically positioned about bowl 12 near the upper portion thereof. The tubes 64 protrude horizontally through the side wall 16 of the centrifuge bowl into the interior thereof. The tubes 64 serve as exit ports for the removal of lighter phase fluid which accumulates adjacent and radially inward of the heavier phase fluid. Arrows 59 generally indicate the flow of the lighter phase fluid into the tubes 64. While two tubes are shown in the preferred embodiment, it will be noted that any number of tubes, preferably symmetrically positioned about the centrifuge so as to achieve a balanced effect during rotation of the bowl may be utilized. In addition, in yet another embodiment one exit tube 64 might be utilized with a suitable counter balancing weight to assure proper balance.

Tubes 64 are adjustably mounted in the side wall 16 of the centrifuge bowl 12 so that the ends 66 thereof can be adjustably positioned at varying radial distances into the centrifuge bowl 12. The tubes may be adjusted such that each tube extends the same radial distance into the centrifuge bowl 12 or an unequal radial distance wherein the tube extending farthest radially inward is utilized for discharging excess lighter phase fluid.

In the embodiment shown in FIG. 1, the tubes 64 are mounted in threaded inserts 65 which typically are an expansion type fitting having a collar portion 67 for retaining the fitting in the wall of the centrifuge bowl. The tubes 64 are then threaded into inserts 65 and are adjusted by simply rotating the tubes in their threaded inserts 65. Typically, the tubes 64 will be adjusted at the time of centrifuge assembly, however, a user may adjust the tubes 64 if necessary. A suitable sealant may be utilized to assure a fluid tight seal between the fittings and the wall. The tube ends 66 are positioned from a location slightly radially outwardly to a location slightly radially inwardly of the boundary between the heavier phase fluid and the lighter phase fluid depending on the desired mode of operation.

If the tube ends 66 are positioned radially outwardly of the boundary separating the phases, the tubes 64 provide a scavenging effect tending to keep the surface of the heavier phase fluid free of the lighter phase fluid or oil. This serves to minimize the possibility of carry over of the lighter phase fluid into the heavier phase fluid exit ports 50. In this mode of operation, heavier phase fluid will exit centrifuge bowl 12 via tubes 64 along with the lighter phase fluids.

If tubes 64 are positioned radially inwardly of the boundary between the different phases of fluid, the lighter phase fluid will be carried off when the layer of lighter phase fluid become thick enough to extend radially inwardly beyond the opened end 66 of the hollow exit tubes 64. Thus the tubes 64 in this position, minimize the carry over of heavier fluid with the lighter fluid. However, tubes 64 must be adjusted to avoid carry over of the lighter phase fluid with the heavier fluid through the exit ports 50. It will be noted that the exact radial and vertical positioning of the tubes 64 will vary depending of the fluid volume flow rates, the rate of bowl rotation, the nature of the fluids, etc.

As illustrated in FIG. 1, the hollow tubes 64 are interconnected with a passage 68 extending circumferentially about centrifuge bowl 12. The oil or lighter phase fluid passage 68 is defined by baffles or splash cones 60 and 70. An oil recovery outlet 72 is tangentially attached to the oil passageway to provide an exit path for the carrying off of the oil or lighter phase fluid.

Purging of solid particles or sediment accumulated on the walls of the centrifuge bowl 12 may be accomplished with one or a combination of apparatus. One method of purging is the abrupt braking or slowing down of the centrifuge bowl 12 via the use of a braking apparatus. In this fashion, build up on the walls 16 of the centrifuge bowl is removed by the rotational energy stored within the fluid which continues to rotate when the centrifuge bowl 12 is stopped.

In the embodiment shown in FIG. 1, a pneumatic disc brake or air brake apparatus 74 suitably mounted on cover member 28 of housing 14 is utilized to suddenly stop the centrifuge bowl when a purge cycle is initiated. (Note a special brake motor having its own braking system might also be utilized.) In one embodiment of the present invention, prior to activating the air brake 74, the pump transfering contaminated fluid into the centrifuge via feed pipe 42 is stopped. The motor 35 is then switched off and the air brake 74 is activated via air line 75. When the brake 74 is actuated, a shoe 76 is driven upward and held against a radially extending projection 78 of a cylindrical collar 81 suitably attached to shaft 30. In the preferred embodiment shown, collar 81 is attached by a key and set screw combination 79 to the shaft 30. Consequently, the shaft 30 stops as does the centrifuge bowl 12 when the air brake 74 is activated, thereby creating a scouring or eroding action by the continuous rotating or sloshing movement of the fluid after the bowl has stopped. Any sediment or solids in the centrifuge bowl are washed out of the centrifuge by the fluid draining downwardly and through the opening 40 in the annular plate 36 and between the periphery of the annular plate 36 and the cylindrical side wall 16. The sediment then drains through the aperture 21 in the bottom of the centrifuge bowl 17 and into the conical shaped member 26 at the bottom of the centrifuge housing 14.

The motor 35 and the air brake 74 may be activated automatically on a timed interval or manually as required. Additionally, during a purge cycle the motor and air brake may be intermittently switched on and off while the fluid pump is switched off. Thus, no new fluid is introduced into the centrifuge and the same fluid can be sloshed and agitated a number of times to purge the centrifuge. The fluid with the purged residue is then flushed out of the centrifuge. Note that since the rotating or spiralling fluid has a purging effect once the centrifuge bowl 12 is stopped, if the fluid can be retained in the centrifuge a significant period of time while rotating, more efficient purging can be accomplished. The annular plate 36 of the present invention serves just such a function by inhibiting the rapid draining of fluid from the bowl once the bowl is no longer rotating.

Another purge method which can be utilized in conjunction with the above described method is the utilization of a plurality of vertically oriented purge rods 80 symmetrically disposed about the centrifuge axis of rotation. In the preferred embodiment illustrated in FIGS. 1 and 3, two purge rods 80, made from a flat rectangular steel bar which is diagonally cut along a major longitudinal portion thereof between the ends thereof so as to be generally wedge shaped or triangular in horizontal cross section are utilized. The oblique side or hypotenuse of each of the purge rods 80 faces the centrifuge bowl wall 16 and the relatively flat horizontal side faces the interior of the bowl. Purge rods 80 in the embodiment shown, are cylindrical and threaded at the top end thereof for threading into bowl cover 18 and are cylindrical near the bottom end thereof so as to extend through semi-cylindrical openings proximate the periphery of the annular plate 36 near the bottom of the centrifuge bowl. The purge rods are illustrated as extending only slightly beyond the annular plate 36 such that the lower ends are retained in position by the semi-cylindrical openings. In addition, as illustrated in FIG. 2, notches or semi-cylindrical openings 81 are positioned proximate the periphery of shield plate 52 to enable the top cylindrical portion of the purge rods 80 to extend therethrough to the top cover member 18.

In a preferred embodiment, the oblique side of the purge rods intersects with the relatively flat side at approximately 28 degrees so as to form a relatively pointed front edge facing opposite the direction of fluid rotation. The purge rods 80 assist in purging the centrifuge bowl 12 by directing rotating fluid outwardly toward the centrifuge wall 16 and further disrupting the rotating fluid. The purge rods 80 are able to redirect fluid flow with minimal loss of energy.

In the preferred embodiment shown, one or more liquid spray nozzles 82 are suitably mounted in the air space or cavity near the center of the centrifuge bowl to assist in the purging process in certain applications. In certain applications, a gelatinous residue or a residue, which readily adheres or sticks to the inner surface of the centrifuge wall 16, may be deposited on the centrifuge wall 16. Although such a residue is typically a small portion of the total residue, the nozzles 82 will aid in removing such a residue. Liquid jets or sprays are utilized after the centrifuge bowl has drained, to loosen any remaining solids or material adhereing to the bowl side wall. Liquid spray nozzles 82 are suitably mounted at the end of a conduit 84 which extends vertically through the aperture 21 into the centrifuge bowl interior a predetermined axial distance. The conduit 84 is releasably connected to housing 14 by connectors 87 which are in turn releasably attached to an external pressurized fluid supply line 88. In the preferred embodiment, two multi-directional spray nozzles 82 are mounted so as to be aligned and capable of spraying in opposite radial directions. As the bowl side wall 16 rotates about nozzles 82, the side wall inner surface will be cleaned.

Figure 4:
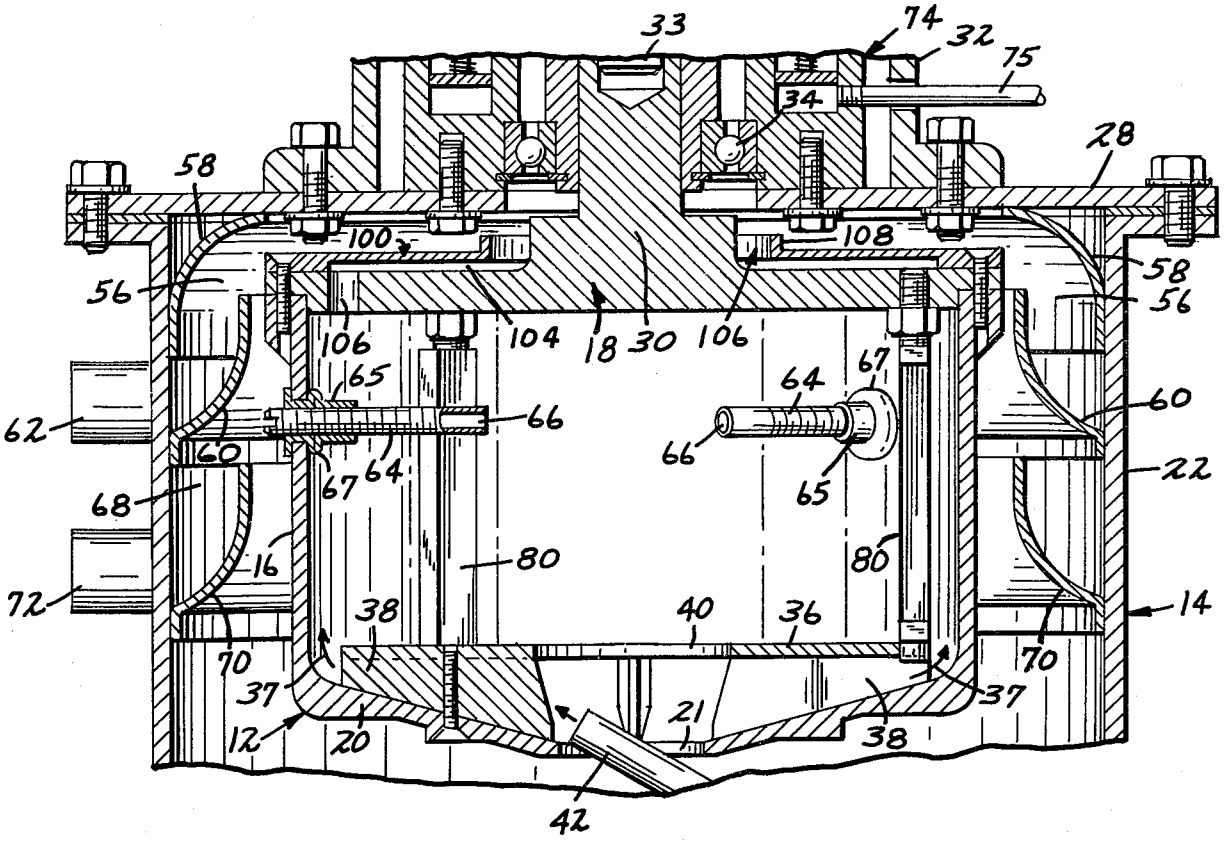
FIG. 4 is an enlarged fragmentary view similar to FIG. 1 showing an alternate embodiment of the present invention.

In an alternate embodiment of the present invention shown in FIG. 4, spray nozzles 82 are not utilized.

Although not necessary, the incoming flow of contaminated fluid is generally shut off or reduced during the purge cycle. The purge cycle may be initiated either at periodic intervals or by a sensor which may be activated upon detection of a predetermined time interval, fluid flow rate, solid particulate buildup, etc. In any case, purging generally occurs before the impeller section or the exit ports 50 are restricted or as to prohibit efficient operation.

It will be appreciated that a working relationship must be estblished between the respective sizes of the centrifuge inlets and outlets and rate of rotation such that an excessive buildup of ligher phase fluid does not occur. In addition, the spacing or gap between the cylindrical side wall 16 of the centrifuge bowl and the periphery of the shield plate must be large enough so that accumulation of solids on the side wall 16 does not block the radially extending passages 54 and yet small enough to prevent spillage or fluid with resuspended particles therein from flowing out of the centrifuge bowl during a purging cycle. In certain applications, a spacing of ¼" to ½" between the periphery of the shield plate 52 and the side wall 16 has been found effective.

FIG. 4, an enlarged fragmentary view similar to FIG. 1, shows an alternate embodiment of the present invention. In this embodiment, an annular overflow plate 100 is coaxially and fixedly attached to the top surface of the centrifuge bowl top cover member 18 for rotation therewith. The annular flow plate 100 defines an aperture 102 in the center thereof such that the inner edge of the annular plate 100 is spaced from the shaft or axial extension 30 of the cover member so as to define a flow path between the inner edge of the annular plate 100 and the axial extension 30. The annular plate 100 further defines radially extending passageways 104 from the aperture 102 to proximate the periphery of the annular plate 100. Exit ports 106 extend from the radially directed passageways 104 to the interior of the centrifuge bowl 12 near the periphery thereof. In operation, the heavier phase fluid flows out of the centrifuge bowl and into the passageways 104.

At the inner edge of the annular plate 100 is a raised lip or flange portion 108. The heavier phase fluid flows from the passageways 104 through aperture 102 and over the flange portion 108 into the space or cavity 53 defined by the top cover member 18 and the housing cover 28. As the fluid enters the cavity 53, it flows radially outwardly toward the housing side wall 14 above the surface of the cover member.

It is to be understood, however, that even though these numerous characteristics and advantages of the invention have been set forth in the foregoing description, together with details of the structure and function of the invention, the disclosure is illustrative only, and changes may be made in detail, especially in matters of shape, size and arrangement of parts within the principle of the invention, to the full extent indicated by the broad general meaning of the terms in which the appended claims are expressed.

What is claimed is:

1. A centrifuge appartus for separating multi-phase fluid, comprising:

(a) a housing having a vertical axis;

(b) a bowl having a cylindrical side wall portion and a bottom wall portion, said bowl being enclosed by a top wall member, said bowl further being mounted for rotation in said housing about said vertical axis;

(c) means for introducing multi-phase fluid into said bowl proximate the bottom portion thereof;

(d) means for driving said bowl at a predetermined rotational speed;

(e) a rotor assembly coaxially mounted in said bowl proximate said bottom portion for rotation with said bowl, said rotor assembly rotating with said bowl to impel the multi-phase fluid and any solid particles suspended therein outwardly toward said cylindrical side wall portion, whereby said fluid is separated by centrifugal forces into heavier phase fluid and ligher phase fluid while said solid particles are collected on the inner surface of said cylindrical side wall portion;

(f) said top wall member defining openings therein for discharging said heavier phase fluid;

(g) baffle means extending transversely of said bowl proximate said top wall member for preventing said lighter phase fluid from discharging through said openings in said top wall member;

(h) discharge means positioned in sid cylindrical side wall portion and extending radially into the interior of said bowl for discharging said lighter phase fluid;

(i) purge means for stopping the rotation of said bowl thereby initiating a purge cycle defined by the disruption of the rotation of said fluid, whereby solid matter accumulated on the inner surface of said cylindrical side wall portion is dislodged therefrom and resuspended in the fluid; and (j) drain means in said bowl for draining said fluid with said resuspended particles from said bowl during the purge cycle.

2. A centrifuge apparatus in accordance with claim 1, wherein said purge means includes a plurality of vertically extending elongated rods, said rods being symmetrically positioned about said vertical axis and being fixedly attached to said centrifuge bowl for rotation therewith, whereby upon the stopping of said bowl by said purge means, said purge rods further disrupt rotation of said fluid thereby aiding and dislodging said particles from said inner surface of said cylindrical side wall portion.

3. A centrifuge apparatus in accordance with claim 2, wherein each of said purge rods is generally wedge-shaped in cross-section along a major portion of the longitudinal extent thereof, each of said purge rods having a relatively pointed edge and a blunt edge, said pointed edge facing in a direction opposite the direction of rotation of said rotating bowl.

4. A centrifuge apparatus in accordance with claim 1, wherein said centrifuge includes drain baffle means proximate said bottom wall portion and extending transversely of said centrifuge bowl for reducing the rate at which the fluid drains from said centrifuge bowl during the purge cycle, whereby said fluid is retained in said centrifuge bowl during the purge cycle for an increased period of time, thereby enabling additional purging by said rotating fluid to occur.

5. A centrifuge apparatus in accordance with claim 1, wherein said centrifuge include means for cooperating with said baffle means to retain said rotating fluid therebetween, said means including a plate-like member being vertically spaced from said baffle means.

6. A centrifuge apparatus for separating multi-phase fluid, comprising:

(a) a rotatably mounted hollow bowl-like structure including a cylindrical side wall portion and a bottom wall portion, said bowl-like structure being enclosed by a top wall member;

(b) means for introducing multi-phase fluid into said bowl-like structure proximate the bottom portion thereof;

(c) means for driving said bowl-like structure at a predetermined rotational speed;

(d) a rotor assembly coaxially mounted in said bowl-like structure proximate the bottom portion thereof, said rotor assembly including a transversely extending annular plate fixedly attached to said bottom portion by a plurality of spaced standoffs, said standoffs constructed and arranged to rotate with said bowl-like structure and impart an outward and rotational motion of said fluid as said fluid is introduced into said bowl-like structure, said transversely extending annular plate having an outside diameter less than the inside diameter of said bowl-like structure;

first means in said top wall member for discharging heavier phase fluid from said bowl-like structure;

(f) second means in said cylindrical side wall portion for discharging said lighter phase fluid from said bowl-like structure;

(g) purge means for stopping the rotational motion of said bowl-like structure to initiate a purge cycle whereby solid matter collected on the inner surface of said cylindrical side wall portion is removed therefrom and resuspended in said fluid; and (h) drain means in said bowl-like structure for draining said fluid with said resuspended particles from said bowl-like structure during the purge cycle.

7. A centrifuge apparatus in accordance with claim 6, wherein said second discharging means includes a plurality of elongated tubular members adjustably mounted in said cylindrical side wall portion and extending radially inwardly toward the interior of said centrifuge bowl.

8. A centrifuge apparatus in accordance with claim 7, wherein said elongated tubular members each have an end threaded on the outside surface thereof, each of said elongated tubular member ends mounted in a threaded mounting element in said cylindrical side wall portion, whereby said elongated tubular members can be radially adjusted by rotating said tubular members about the longitudinal axis.

9. A centrifuge apparatus in accordance with claim 8, wherein a shield plate member is positioned in said centrifuge bowl proximate said first discharge means, said shield plate member defining passageways extending radially outwardly from said first discharge means.

* * * * *

UNITED STATES PATENT AND TRADEMARK OFFICE

CERTIFICATE OF CORRECTION

PATENT NO. : 4,406,651

DATED : September 27, 1983

INVENTOR(S) : Denis J. Dudrey et al

It is certified that error appears in the above-identified patent and that said Letters Patent is hereby corrected as shown below:

Column 2, line 33, "particularlity" should be --particularity--.

Column 3, line 21, "Conentrically" should be --Concentrically--.

Column 3, line 49, "rotations" should be --rotates--.

Column 3, line 59, "aperature" should be --aperture--.

Column 4, line 60, "plte" should be --plate--.

Column 8, line 33, "adhereing" should be --adhering--.

Column 8, line 58, "estblished" should be --established--.

Column 9, line 59, "ligher" should be --lighter--.

Column 10, line 1, "sid" should be --said--.

Column 10, line 41, "include" should be --includes--.

Signed and Sealed this

*Tenth* Day of *January 1984*

[SEAL]

*Attest:*

GERALD J. MOSSINGHOFF

*Attesting Officer*

*Commissioner of Patents and Trademarks*